United States Patent [19]

Zielinski et al.

[11] Patent Number: 4,906,412

[45] Date of Patent: Mar. 6, 1990

[54] STABILIZATION OF LAURIC FATS AND OILS

[75] Inventors: Richard J. Zielinski, Middleburg Heights; Daniel A. Ebner, Cleveland, both of Ohio

[73] Assignee: Durkee Industrial Foods Corp., Cleveland, Ohio

[21] Appl. No.: 178,831

[22] Filed: Mar. 28, 1988

Related U.S. Application Data

[63] Continuation-in-part of Ser. No. 832,095, Feb. 20, 1986, abandoned.

[51] Int. Cl.[4] ..... C11B 5/00

[52] U.S. Cl. ..... 266/398.5

[58] Field of Search ..... 260/398.5

[56] References Cited

U.S. PATENT DOCUMENTS 2,494,114 1/1950 Black ..... 260/398.5
2,981,628 4/1961 Hall ..... 260/398.5
4,524,085 6/1985 Purves et al. ..... 426/601
4,528,201 7/1985 Purves ..... 426/262

OTHER PUBLICATIONS

Food Oils and Their Uses, Second Ed., T. J. Weiss, The AVI Publishing Co. copyright 1983) (p. 289).

A Process for the Separation of Phosphatide Mixtures: The Preparation of Phosphatidylethanolamine-Free Phosphatides from Soya Lecithin, R. Aneja, Fette/-Seifen/Anstrichmittel, vol. 10, 1971, pp. 643-651.

Kirk-Othmer, *Encyclopedia of Chemical Technology*, vol. 8, pp. 781 and 805-807, (1965).

*Primary Examiner*—Anton H. Sutto

*Attorney, Agent, or Firm*—Tarolli, Sundheim & Covell

[57] ABSTRACT

An improved process for the treatment of lauric fats and oils to reduce or prevent both hydrolytic and oxidative rancidity comprising adding to said fat or oil a sequestering amount of citric acid, and with said citric acid lecithin in the amount of at least about 30 ppm (parts per million) based on the weight of the fat or oil.

17 Claims, No Drawings

STABILIZATION OF LAURIC FATS AND OILS

This is a continuation-in-part of co-pending application Ser. No. 832,095 filed on Feb. 20, 1986, now abandoned.

The present invention relates to the stabilization of lauric fats and oils, and more particularly to the prevention of both oxidative and hydrolytic rancidity in fats and oils.

BACKGROUND OF THE PRESENT INVENTION

When an oil becomes oxidized, it first develops hydroperoxides. Hydroperoxides have no flavor or odor. However, they break down rapidly to fform aldehydes, which have a strong, disagreeable flavor and odor. The overall flavor defect is called oxidative rancidity.

It is well known to subject fats and oils to final deodorization in the process of preparing them for commercial use. Deodorization is the process whereby odors and flavors of fats and oils are removed, usually by blowing steam through hot oil at 200°-275° C. (392°-527° F.) under low pressure (3-10 Torr).

It is a desirable practice in deodorization, as a final step, to add citric acid to the oil. It is usually added as a water solution under vacuum, so that the water is evaporated off. The citric acid functions as a metal scavenger, especially for traces of copper and iron which act as pro-oxidants for oil. If citric acid is not added, the oil can revert and oxidize more rapidly.

Hydrolytic rancidity is the reaction of triglycerides with water, to produce glycerin and free fatty acids. The reaction can be exemplified by the following equation:

$$C_3H_5(OOCR)_3+3HOH=C_3H_5(OH)_3+3HOOCR$$

Prior to deodorization, fats and oils are usually subjected to alkali refining. Alkali refining is effective to achieve almost complete removal of free fatty acids. The free fatty acid content is determined by titration of a sample with a standard solution of sodium hydroxide (AOCS method Ca5a-40).

However, after refining, oil is often held in storage tanks. Water vapor can get into these tanks through breather pipes and condense on cooling. The free fatty acid content can increase again because of the presence of such water. Deodorization, the final process before the fat or oil is packaged, lowers free fatty acid and water to about 0.05% or less. However, moisture in pipe lines, feed tanks, beading towers, and flaking rolls as well as tank wagons and cars, can again cause subsequent increase in moisture, in turn causing again an increase in free fatty acid content.

Lauric fats and oils, such as coconut oil and palm kernel oil, are particularly subject to hydrolytic rancidity. Hydrolysis of coconut oil or palm kernel oil, even to a small extent, liberates short-chain fatty acids, which are highly flavored and have a very disagreeable soapy flavor.

The problem with the presence of citric acid in lauric fats and oils, when accompanied by moisture, is that the citric acid, in effect, can function as a catalyst in the hydrolysis reaction, causing an increase in percent free fatty acid. Work carried out in connection with the present invention has demonstrated that the rancidity occurred at a rate proportional to the level of citric acid present. The most stable fractionated palm kernel oil samples obtained other than by the present invention were those containing no citric acid and low levels of water (below 0.01%).

As a result, citric acid is normally added only to domestic fats and oils, and not lauric fats and oils.

Lecithin is a well-known additive to fats and oils for a number of purposes, mostly involving emulsification or viscosity reduction. For instance, lecithin is used to reduce the viscosity of confectionery coatings, or as an emulsifier in such products as ice cream, bread, icings, paints, cosmetics, printing inks, and the like. Also, it is known to have a synergistic action with phenolic antioxidants and may be used for this purpose. In such uses, the amount employed can be characterized as an emulsifying amount or antioxidant amount. By way of example, in confectionery products a reduction in viscosity is achieved by the addition of about 0.1-0.4% lecithin, based on the weight of the coating.

It is also known to package lauric hard butters with about 0.1% lecithin added as a moisture scavenger. This is said to reduce the potential of developing hydrolytic rancidity in a stored, deodorized fat. This disclosure can be found in the book "Food Oils and Their Uses", Second Edition, Theodore J. Weiss, The Avi Publishing Co., Inc. copyright 1983 (page 289).

Prior patent to Black, U.S. Pat. No. 2,494,114, describes the stabilization of fatty materials by the addition of an anti-oxidant known as "NDGA" (dihydroguaiaretic acid). The patent suggests that improved stabilization against rancidity produced by oxidation can be achieved by the use of lecithin or citric acid in combination with NDGA. One sample reported in the patent contains all three ingredients, NDGA, 0.002% citric acid, and 0.03% lecithin. However, the data given with regard to rancidity produced by oxidation (rancid in 80 days) was no better than that obtained by the use of NDGA and citric acid alone (also 80 days). The patent makes no mention of hydrolytic rancidity, nor the particular problems associated with lauric fats and oils.

Applicants know of no disclosure that teaches treating lauric fats or oils with citric acid, to sequester traces of copper and iron, and then further adding lecithin for the purpose of achieving substantially complete resistance to not only oxidative rancidity but also hydrolytic rancidity as well.

BRIEF DISCLOSURE OF THE PRESENT INVENTION

The present invention resides in an improved process for the treatment of lauric fats and oils to reduce or prevent both hydrolytic and oxidative rancidity comprising adding to said fat or oil a sequestering amount of citric acid, and with said citric acid, a non functional amount of lecithin in the proportion of at least about 30 ppm (0.003%) up to about 300 ppm (0.03%); By the term "non-functional", it is meant that the amount of lecithin is insufficient to have any functional affect, for instance, emulsification effect or viscosity reduction or any taste affect. This is important since it is often desirable to avoid emulsification or viscosity reduction, and adverse flavors. It is unexpected that such small amount of lecithin would have the effect on the presence of citric acid that it does. based on the weight of the fat or oil.

The present invention is particularly applicable to deodorized lauric fats and oils.

It is necessary that the citric acid be added subsequent to final deodorization, as the acid can decompose at deodorization temperatures. The lecithin can be added prior to or after final deodorization. If added before, the lecithin is preferably free of phosphatidyl ethanolamine (PE). Alternatively, the lecithin can be pretreated with a strongly basic compound following the procedure of Purves patent No. 4,528,201. The disclosure of this patent is incorporated by reference herein.

DETAILED DESCRIPTION OF THE PRESENT INVENTION

For purposes of the present invention, the term "lauric fats and oils" means specifically those fats and oils having a high content of lauric acid (40–60%). They contain smaller amounts of saturated acids having 8, 10, 14, 16 and 18 carbon atoms. Their unsaturated acids are all minor in amount and consist of oleic and linoleic acid. Commercially important fats and oils in this group include palm kernel oil, coconut oil, babassu oil and tucum oil.

It is understood that the present invention broadly is also applicable to blends of fats where part of the blend is a so-called domestic fat (e.g., non-lauric soybean or cottonseed), and part of the blend is a lauric fat or oil. Such blends are particularly common in the confectionery field and can comprise from 5 to 95% lauric fat or oil. For purposes of the present application, the term "lauric" includes such blends.

The lauric fats and oils of the present invention are primarily those which have been subjected to conventional degumming, alkali refining, and bleaching with an absorptive clay or typical physical refining processes. These steps are conventional in the art, and form no part of the present invention. In addition, the fats and oils of the present invention may be subjected to fractionation, hydrogenation, acidolysis, interesterification or rearrangement. The fats and oil may be prepared by a direct esterification of fatty acids and glycerine. A final step in the processing usually is deodorization. With regard to those fats or oils which are fractionated, the present invention is applicable to both the low melting point fractions and the high melting point fractions.

Typical uses for the fats and oils of the present invention are ice cream coatings, confectionery coatings or fillings, whipped toppings, hard butters, plastic shortenings, cocoa butter extenders, and stearines.

Not all lauric oil or fat products require stabilization by the present invention. By way of example, a well processed coconut oil which melts at about 76° F. has, under normal circumstances, good AOM (Active Oxygen Method) stability and citric acid may not be needed. The same is true for hydrogenated coconut oil (mp 76°–100° F.) or hydrogenated palm kernel oil (mp 87°–115° F.).

However, the present invention could have good applicability in those instances where the coconut oil or palm kernel oil, whether or not hydrogenated, is likely to undergo iron pick-up during processing or storage, and be subject to oxidative rancidity. The addition of citric acid in such instances would be useful. Applications for these products are ice creams and whipped toppings.

The present invention has been very advantageously used with a fractionated palm kernel or coconut oil having a Wiley Melting Point in the range of about 89°–93° F., or one that is also hydrogenated having a Melting Point in the range of about 96°–105° F. A primary use for these products is confectionery coatings. The present invention has also been advantageously used with a hydrogenated rearranged coconut or palm kernel oil having a Melting Point in the range of about 93°–104° F. Primary uses for these products are confectionery coatings and vegetable dairy systems. The present invention can also be used advantageously with a lauric stearine.

All of the above applications are food uses. It should be understood that the present invention also has applicability in cosmetic and pharmaceutical applications where both oxidative and hydrolytic rancidity must be avoided.

Citric acid has a decomposition temperature of about 150° C., so that it is necessarily added, as mentioned, subsequent to final deodorization. It can be anhydrous or dissolved in water or another carrier. For ease of dispersibility, a solution is preferred. For food applications the citric acid must be food grade. The amount added is a sequestering amount. The exact amount added will depend upon use, type of fat or oil, type of storage, and other parameters well known in the industry, and is not a part of the present invention. In the examples of the present application, it is added at a level of 20 ppm based on the weight of fat. This is a conventional sequestering amount although amounts of for instance as much as 100 ppm may be employed. The above-mentioned Black Patent reports use of about 10 to 50 ppm (0.001–0.005 percent-claim 3). Also in the examples of this application, it is added as a solution. The carrier used was propylene glycol, with the concentration of citric acid in the carrier being about 10%; other carriers such as water or ethyl alcohol could be used.

The lecithin can be added either prior to or subsequent to final deodorization. Any commercially available lecithin product can be used. Most commercially available lecithins are soybean derived; however, lecithins derived from other oils such as canola oil could be used. An hydroxylated lecithin can also be used.

The lecithin can be in liquid or granular form. All lecithins derived from soybean oil, even granular lecithins, have a characteristic flavor and odor, although in the case of granular lecithin the flavor is a relatively non-objectionable, nutty flavor. If the lecithin is added to the fat or oil prior to final deodorization, the flavor and odor can be improved by removal of volatiles.

It is known, however, that lecithin is subject to degradation from high temperatures, causing darkening of the fat or oil to which it is added. Deodorization is conventionally carried out at 430°–450° F. and will cause oil darkening if the lecithin is added prior to deodorization. This darkening can be prevented or minimized in several ways, one being by treatment of the lecithin with a strong base such as sodium hydroxide, magnesium hydroxide or potassium hydroxide, following the teachings of U.S. Pat. No. 4,528,201. Another is pretreatment of the lecithin dissolved in a small amount of fat by the addition of water followed by heating and filtration, as disclosed in U.S. Pat. No. 4,524,085. The disclosures of these patents are incorporated by reference herein.

The pretreatment process of U.S. Pat. No. 4,524,085 involves adding water to lecithin previously mixed with a small amount of fat. The lecithin is diluted with fat such that the lecithin is from about 5% to about 85%, preferably from about 5% to about 25%, by weight of the lecithin/fat mixture. Water is added in an amount such that it constitutes from about 5% to about 65% by weight of the lecithin, preferably from about 5% to about 50% by weight of the lecithin. The mixture is heated to a temperature of from about 130° F. (54° C.) to about 170° F. (77° C.) with mixing. The mixture is filtered hot.

The treatment process of U.S. Pat. No. 4,528,201 involves adding the base as a water solution, either directly to the fat or as a pretreatment of the lecithin. The amount of basic solution added will depend upon the concentration of the basic solution. Solutions of about 5% to about 50% base by weight are preferred. For weaker bases, solutions of from about 20% by weight base to saturated solutions can be employed. Addition as a solid often results in incomplete dissolution and dispersal in the fat resulting in uneven color development. To retard fat discoloration upon heating, a minimum base concentration of at least about 0.00005% by weight of the fat is required. Preferably, for the compositions of the present invention, the base concentration comprises at least about 0.0003% by weight of the fat. Most preferably, the base concentration comprises a minimum of about 0.0015j% by weight of the fat.

Further details on the amount of base required can be found in the '201 patent.

Any of several stabilization techniques for treatment of the lecithin or fat with a strong base can be employed. Each method is effective to prevent discoloration of the fat. One method to retard discoloration by base stabilization of the lecithin is to add the base directly to the fat either prior to or after addition of the lecithin. No pretreatment of the lecithin is required.

In a pretreatment stabilization process for the lecithin, a strong base is added to lecithin optionally mixed with a small amount of fat, heated and mixed, and added to the lauric fat.

In a third alternative, the base can be added to lecithin optionally mixed with a small amount of fat, heated and filtered, and mixed with the lauric fat. Filtration of the lecithin in combination with the base treatment reduces color development more than the base treatment alone. Much of the lecithin is removed by the filtration, thereby additionally reducing color development. A final pretreatment stabilization process for the lecithin comprises: (1) addition of a strong base to lecithin; (2) optional neutralization of the resulting solution; (3) extraction of the lecithin with a nonpolar solvent, and (4) addition of the lecithin to a lauric fat. The neutralization is usually accomplished by addition of an acid such as phosphoric acid. Hexane, or other similar nonpolar solvents are employed for the extraction step. The extracted lecithin can be heated to aid in its dispersion in the lauric fat. An equivalent procedure is to dissolve crude lecithin in a nonpolar solvent such as hexane with the strong base, neutralize with an acid/base titration, extract the lecithin, wash it with a solvent such as acetone, and add it to the desired fat.

In a paper entitled "A Process for the Separation of Phosphatide Mixtures: The Preparation of Phosphatidyl Ethanolamine-Free Phosphatides from Soya Lecithin", R. Aneja et al, it is disclosed that phosphatidyl choline (PC), phosphatidyl ethanolamine (PE) and phosphatidyl inositol (PI) are the three major phosphatide constituents of soya lecithin. This paper discloses a process for separation of phosphatidyl choline and phosphatidyl inositol from commercial soya lecithin, to give a product which is free of phosphatidyl ethanolamine. The three chief phosphatides, PC, PE and PI, are generally present in approximately equal amounts in soybean lecithin. In this paper, it is disclosed that PE has a deleterious affect on the anti-spattering properties of PC and would best be removed completely from the mixture. There is no reference in this paper to the processing of fats, particularly lauric fats and oils, or to the use of lecithin prior to deodorization.

The present invention, in part, resides in the discovery that removal of PE from lecithin is also effective in minimizing thermal darkening of lauric fats and oils during deodorization. The disclosure of the Aneja et al paper is incorporated by reference herein.

In the following Examples, parts expressed are parts by weight, and percentages are percentages by weight.

EXAMPLE 1

This Example illustrates the effect of treating a hydrogenated and rearranged lauric fat with both citric acid and lecithin. The citric acid was added in a sequestering amount. Both the lecithin and citric acid were added subsequent to final deodorization.

The particular fat treated was Paramount B (trademark Durkee Industrial Foods Corp.), a partially hydrogenated rearranged palm kernel oil having a Wiley Melting Point of about 93°-96° F., an IV of about 3 maximum, a free fatty acid content of about 0.05 maximum and an SFI profile as follows:

| Temperature | Solids |
|---|---|
| 50° F. | 64 min. |
| 70° F. | 51 min. |
| 80° F. | 35 min. |
| 92° F. | 6 min. |
| 100° F. | 1 max. |

The fat is conventionally used in confectioner's coatings, vegetable dairy systems, candy centers, icings, cosmetics and pharmaceutical products.

The lecithin treatment was carried out in one series of runs with a typical natural, fluid, soybean lecithin marketed under the trademark Actiflo 68-SB by Central Soya. This lecithin is in solution form comprising about 66-68% active phospholipids (about 44-23% PC, 22-20% PE, and 0-14% PI). It is marketed as an amber fluid.

In a second series of runs, the lecithin treatment was carried out with a hydroxylated soybean lecithin marketed by Central Soya under the trademrk Centrolene A. This product has about 58% active phospholipids and is marketed as a heavy bodied fluid.

In the treatment process, the citric acid was added as a 10% propylene glycol solution. It was added in an amount necessary to give the oils a citric acid concentration of 20 ppm. There is no criticality with regard to order of addition.

Water also was added to all samples, except control samples, to apply a simulated stress to the lauric fat. The water was added at percent levels of 0.05 and 0.10. The lecithin was added in the amounts of zero and 250 ppm. No advantage was seen in exceeding a concentration of 250 ppm.

The procedure followed was adding warm distilled water directly to the oil, which was heated to about 50° C. A nitrogen atmosphere was maintained over the oil while it was mixed for 15 minutes with a mechanical stirrer (3000 RPM). The samples requiring no added water were still subjected to the 15 minute mixing under nitrogen at 50° C. The results obtained are given in the following Table 1 (for the addition of Actiflo lecithin) and Table 2 (for the addition of hydroxylated lecithin). Storage results in terms of free fatty acid and flavor development were obtained at intervals of two months, four months, and six months.

TABLE 1

| PARAMOUNT B w/CITRIC - 6 MONTH AMBIENT STORAGE LECITHIN ADDITION | | | | | | | | | | |
|---|---|---|---|---|---|---|---|---|---|---|
| SAMPLE | PPM LECITHIN | % ADDED $H_2O$ | INITIAL % FFA | INITIAL FLAVOR | 2 MONTHS % FFA | 2 MONTHS FLAVOR | 4 MONTHS % FFA | 4 MONTHS FLAVOR | 6 MONTHS % FFA | 6 MONTHS FLAVOR |
| 1 | 0 | 0 | 0.02 | 6.0/7.2 | 0.09 | 5.5/5.7 | 0.14 | 5.5/5.0 | 0.15 | —/5.5 |
| 2 | 250 | 0 | 0.04 | 6.0/7.5 | 0.01 | 7.0/7.7 | 0.03 | 6.5/6.8 | 0.03 | —/6.5 |
| 3 | 0 | 0.05 | 0.05 | 8.0/6.0 | 0.30 | 5.0/5.0 | 0.32 | 5.5/5.0 | 0.38 | —/5.0 |
| 4 | 250 | 0.05 | 0.06 | 7.5/8.0 | 0.02 | 8.0/7.7 | 0.04 | 7.0/6.8 | 0.03 | —/6.2 |
| 5 | 0 | 0.10 | 0.03 | — | 0.44 | 4.0/4.0 | 0.52 | 5.0/5.0 | 0.56 | 4.5/5.2 |
| 6 | 250 | 0.10 | 0.02 | — | 0.01 | 6.0/7.0 | 0.03 | 7.0/7.2 | 0.02 | 6.0/6.8 |

TABLE 2

| PARAMOUNT B w/CITRIC ACID - 6 MONTH AMBIENT STORAGE HYDROXYLATED LECITHIN ADDITION | | | | | | |
|---|---|---|---|---|---|---|
| SAMPLE | PPM HYDROXY LECITHIN | % ADDED $H_2O$ | INITIAL % FFA | 2 MONTHS % FFA | 4 MONTHS % FFA | 6 MONTHS % FFA |
| 1 | 0 | 0 | 0.14 | 0.12 | 0.19 | 0.19 |
| 2 | 250 | 0 | 0.16 | 0.02 | 0.04 | 0.02 |
| 3 | 0 | 0.05 | 0.28 | 0.36 | 0.41 | 0.42 |
| 4 | 250 | 0.05 | 0.23 | 0.03 | 0.02 | 0.02 |
| 5 | 0 | 0.10 | 0.04 | 0.46 | 0.57 | 0.53 |
| 6 | 250 | 0.10 | 0.02 | 0.01 | 0.03 | 0.02 |

The data of Table 1 shows that in a hydrogenated rearranged lauric fat the free fatty acid content, with no lecithin added (samples 1, 3 and 5) increased substantially even with no water present. In sample 1, with no water added, the increase was from 0.02 to 0.15% over the storage period. In sample 3, having 0.05% added water, the increase was to 0.38%, and in sample 5, the increase was to 0.56%.

All samples showed corresponding decreases in flavor. A lower flavor value indicates poorer flavor, with optimum being about 8, plus or minus, with an acceptible flavor rated about a 7. The flavor score is a subjective panel evaluation only and is subject to substantial error or deviation. However, the data does show a flavor deterioration for the lecithin-free samples from a mean of about 6.8 to a mean of about 5.

By contrast, samples 2, 4 and 6 containing 250 ppm lecithin were both free fatty acid and flavor stable, showing virtually no hydrolysis even with water levels of 0.05% and 0.10% (samples 4 and 6). The flavor scores of the lecithin containing samples decreased slightly during storage from a mean score of about 7.2 initially to a mean score of 6.4 at six months.

Again, there appeared to be no advantage in adding lecithin at a level more than 300 ppm, for instance 1000 ppm, although nothing precludes such higher addition, other than economics and avoidance of altering the functional properties of the base fat.

Similar data is given in Table 2, with those samples having hydroxylated lecithin showing little free fatty acid build-up, those without lecithin having substantial build-up, e.g., up to 0.42–0.53%.

No flavor data is given since the hydroxylated lecithin itself tended to impart to the samples a "sour" off-flavor.

EXAMPLE 2

In this Example, the starting oil was fractionated palm kernel oil deodorized to a free fatty acid content of less than 0.01%. The oil had a Mettler Drop Point of about 33.3° C., a calculated IV of about 5, and fatty acid and SFI data as follows:

| | Approximate Value |
|---|---|
| FAC | |
| 12:0 | 58 |
| 14:0 | 21 |
| 16:0 | 8.5 |
| Others | Remainder |
| SFI | |
| 50° F. | 68–75 |
| 70° F. | 62–71 |
| 80° F. | 48–60 |
| 92° F. | 4 max |

The procedure used was the same as in Example 1. The following data was obtained.

TABLE 3

| FRACTIONATED PALM KERNEL w/CITRIC - 6 MONTH AMBIENT STORAGE LECITHIN ADDITION | | | | | | |
|---|---|---|---|---|---|---|
| SAMPLE | PPM ADDED LECITHIN | % ADDED $H_2O$ | INITIAL % FFA | 2 MONTHS % FFA | 4 MONTHS % FFA | 6 MONTHS % FFA |
| 1 | 0 | 0 | 0.01 | 0.01 | 0.02 | 0.01 |
| 2 | 0 | 0.10 | 0.03 | 0.09 | 0.13 | 0.21 |
| 3 | 250 | 0.10 | 0.01 | 0.01 | 0.02 | 0.02 |

In Table 3, sample 1 was a control sample and shows that this oil inherently is very stable. With no water added, even with citric acid present, the sample showed little free fatty acid build-up. However, with the addition of 0.10% water, there was substantial free fatty acid build-up, to about 0.21%. In the presence of lecithin, this build-up was held to about 0.02%.

Similar data was obtained with the use of hydroxylated lecithin. With 0.05% added water and no lecithin, the free fatty acid build-up after six months was about 0.27%. In the presence of 250 ppm hydroxylated lecithin, the free fatty acid build-up was held at about 0.02%, from an initial value of about 0.02%.

EXAMPLE 3

In this example, the lecithin added was a granulated lecithin marketed by Riceland Foods under the trademark Lecigran F. An advantage in using a granulated lecithin is that it is generally free of the characteristic soybean odor. The lecithin was 97% active phopholipids (about 23.5% PC, 20% PE, 14% PI and 39.5% other phospholipids).

The procedure used was the same as in Example 1. The data obtained in Table 4 shows that with as little as 50 ppm granulated lecithin the free fatty acid build-up is negligible.

TABLE 4

| Granulated Lecithin | Citric Acid | Water | Initial % FFA | 1 month % FFA | 2 months % FFA | 3 months % FFA |
|---|---|---|---|---|---|---|
| 200 ppm | 20 ppm | .1% | .02 | .02 | .03 | .03 |
| 100 ppm | 20 ppm | .1% | .02 | .02 | .02 | .02 |
| 50 ppm | 20 ppm | .1% | .02 | .02 | .02 | .02 |
| 0 ppm | 20 ppm | .1% | .03 | .11 | .16 | .17 |

With up to 250 ppm granulated lecithin added, the same is non-detectable in terms of odor and flavor.

EXAMPLE 4

In this Example, water was added to a lauric fat to determine the effect the addition of water had in the absence of citric acid. The fat selected was Paramount B, the saame fat used in Example 1. The same procedures of Example 1 were employed, and the following results were obtained:

TABLE 5

| Sample | PPM Lecithin | % Added $H_2O$ | Initial | % Free Fatty Acid 2 Months | 4 Months | 6 Months |
|---|---|---|---|---|---|---|
| 1 | 0 | 0 | 0.01 | 0.02 | 0.01 | 0.01 |
| 2 | 250 | 0 | 0.01 | 0.03 | 0.02 | 0.02 |
| 3 | 0 | 0.05 | 0.02 | 0.06 | 0.06 | 0.07 |
| 4 | 250 | 0.05 | 0.02 | 0.02 | 0.02 | 0.02 |
| 5 | 0 | 0.10 | 0.03 | 0.15 | 0.22 | 0.16 |

TABLE 5-continued

| Sample | PPM Lecithin | % Added $H_2O$ | Initial | % Free Fatty Acid 2 Months | 4 Months | 6 Months |
|---|---|---|---|---|---|---|
| 6 | 250 | 0.10 | 0.02 | 0.05 | 0.02 | 0.02 |

The fat showed little degradation in the absence of citric acid. The following table compares the data obtained with data of Example 1 (The comparative data was extracted from samples 1, 3, and 5 of each Table.).

TABLE 6

| Percent Water | Table 5 Data/ Percent Free Fatty Acid Range Without Citric Acid Added** | Table 1 Data/ Percent Free Fatty Acid Range With Citric Acid Added*** |
|---|---|---|
| 0 | 0.01 to 0.01 | 0.02 to 0.15 |
| 0.05 | 0.02 to 0.07 | 0.05 to 0.38 |
| 0.10 | 0.03 to 0.16 | 0.03 to 0.56 |

The above comparative data indicates that the presence of citric acid, in the worst cases, after six months, caused about a 4 to 5-fold increase in fatty acid concentration. This is sufficient to have a substantial, adverse, flavor impact on the lauric fat.

EXAMPLE 5

In this Example, a series of comparative tests were conducted on non-lauric and lauric fats to determine if the free fatty acid build-up from the addition of citric acid would be evident in all fats or just lauric-type fats. The non-lauric fat employed was a non-lauric cocoa butter (c/b) substitute marketed by Durkee Industrial Foods Corp under the trademark Kaobien 10-01. It is a fractionated non-lauric sal fat and fractionated palm oil blend described in U.S. Pat. No. 4,465,703, issued Aug. 14, 1984. The fatty acid content of Kaobien 10-01 is approximately 26–28% stearic (18:0) and 33–35% oleic (18:1), 30–32.5% palmitic (16:0), and zero percent lauric.

The lauric fat employed was a fractionated palm kernel oil having a Wiley Melting Point of about 91° F., an I.V. of about 7 and a fatty acid content which was primarily about 56% lauric (12:0) and 21% myristic (14:0).

Samples of each oil, containing two levels of water (0.01 and 0.1 percent) were stored at 70° F. and 85° F., and tested periodically for free fatty acid content. One set of samples was free of citric acid. A second set contained 100 parts per million citric acid (20% citric acid in propylene glycol added directly to the oils after deodorization).

The following data was obtained:

TABLE 7

| Type Oil | Temp °F. | Initial Free Fatty Acid | Percent Water | Amount Citric | Free Fatty Acid After | Weeks |
|---|---|---|---|---|---|---|
| Set No. 1 | | | | | | |
| Lauric | 70 | 0.011 | 0.01 | 0 | 0.014 | 17 |
| | 70 | 0.011 | 0.10 | 0 | 0.015 | 17 |
| | 85 | 0.011 | 0.01 | 0 | 0.007 (0.01) | 17 |
| | 85 | 0.011 | 0.10 | 0 | 0.017 | 17 |
| Set No. 2 | | | | | | |
| Lauric | 70 | 0.041 | 0.01 | 100 | 0.28 | 12 |
| | 70 | 0.041 | 0.10 | 100 | 0.56 | 12 |
| | 85 | 0.041 | 0.01 | 100 | 0.11 | 12 |
| | 85 | 0.041 | 0.10 | 100 | 0.37 | 12 |
| Set No. 3 | | | | | | |

TABLE 7-continued

| Type Oil | Temp °F. | Initial Free Fatty Acid | Percent Water | Amount Citric | Free Fatty Acid After | Weeks |
|---|---|---|---|---|---|---|
| Non-Lauric c/b Substitute | 70 | 0.015 | 0.01 | 0 | 0.025 | 17 |
| | 70 | 0.015 | 0.10 | 0 | 0.025 | 17 |
| | 85 | 0.015 | 0.10 | 0 | 0.024 | 17 |
| | 85 | 0.015 | 0.10 | 0 | 0.026 | 17 |
| Set No. 4 | | | | | | |
| Non-Lauric c/b Substitute | 70 | 0.05 | 0.01 | 100 | 0.11 | 12 |
| | 70 | 0.05 | 0.10 | 100 | 0.22 | 12 |
| | 85 | 0.05 | 0.01 | 100 | 0.060 | 12 |
| | 85 | 0.05 | 0.10 | 100 | 0.090 | 12 |

From the above, it can be seen that in Set No. 1, a lauric fat with no citric acid added, there was no significant increase in free fatty acid after 17 weeks storage. In contrast, in Set No. 2, a lauric fat with 100 parts per million citric acid, after only 12 weeks there was significantly higher free fatty acid content, particularly at 70 degrees F. (0.28 to 0.56).

In contrast with the above, the non-lauric fat (Sets No. 3 and 4) showed little free fatty acid build up. With no citric acid present, it was essentially on a par with the lauric fat. With citric acid present, there was some free fatty acid build up, mostly at 70 degrees F. (0.11 to 0.22) but the build up was significantly less than with the lauric fat.

The build up attained in the non-lauric fat would be insufficient to develop off-flavors.

We claim:

1. A process for reducing or preventing both hydrolytic and oxidative rancidity in lauric fats and oils comprising the steps of adding to said fat or oil (a) a sequestering amount of citric acid; and (b) lecithin in an amount effective to provide at least about 30 parts per million active phospholipids based on the weight of fat or oil said amount being less than about 300 parts per million.

2. The process of claim 1 wherein said fat or oil is deodorized prior to citric acid and lecithin addition.

3. The process of claim 1 wherein said lecithin is granular.

4. The process of claim 1 or 2 wherein said fat or oil is a fractionated palm kernel or coconut oil.

5. The process of claim 1 or 2 wherein said fat or oil is a hydrogenated, rearranged palm kernel oil having a Wiley Melting Point in the range of about 93°-104° F.

6. The process of claim 1 or 2 wherein said fat or oil is prepared by esterification of fatty acids and glycerine.

7. The process of claim 1 wherein said fat or oil is a blend of a lauric fat or oil with a non-lauric fat or oil.

8. The process of claim 1 wherein the lecithin is added prior to deodorization and is substantially free of phosphatidyl ethanolamine.

9. The process of claim 1 wherein said lecithin is added prior to deodorization and is treated with a strong base.

10. The process of claim 1 wherein said lecithin is dissolved in a carrier oil such as coconut, palm kernel or soybean oil.

11. The process according to claim 1 wherein said lecithin is used in an effective amount to provide less than about 250 parts per million.

12. The process according to claim 1 wherein said lecithin is used in an effective amount to provide less than about 250 parts per million and said fat or oil is deodorized prior to citric acid and lecithin addition.

13. The process according to claim 1 wherein said lecithin is used in an effective amount to provide less than about 250 parts per million and said fat or oil is a fractionated palm kernel or coconut oil.

14. The process according to claim 1 wherein said lecithin is used in an effective amount to provide less than about 250 parts per million and said fat or oil is a hydrogenated, rearranged palm kernel oil having a Wily Melting Point in the range of about 93°-104° F.

15. The process according to claim 1 wherein said lecithin is used in an effective amount to provide less than about 250 parts per million and said fat or oil is a blend of a lauric fat or oil with a non-lauric fat or oil.

16. The process according to claim 1 wherein said lecithin is used in an effective amount to provide less than about 250 parts per million and the lecithin is added prior to deodorization and is substantially free of phosphatidyl ethanolamine.

17. A lauric fat or oil treated by the process of any one of claims 1, 2, 3, 7, 8, 9 or 11.

* * * * *